US006716342B1

(12) United States Patent
Tilsner

(10) Patent No.: US 6,716,342 B1
(45) Date of Patent: Apr. 6, 2004

(54) FILTER SYSTEM FOR A SWIMMING POOL

(76) Inventor: Herbert Tilsner, 3111 S. Leland St., San Pedro, CA (US) 90731

( * ) Notice: Subject to any disclaimer, the term of this patent is extended or adjusted under 35 U.S.C. 154(b) by 0 days.

(21) Appl. No.: 10/233,192

(22) Filed: Aug. 29, 2002

(51) Int. Cl.[7] ..... E04H 4/16
(52) U.S. Cl. ..... 210/169; 210/232; 210/416.2
(58) Field of Search ..... 210/169, 232, 210/416.1, 416.2; 4/490

(56) References Cited

U.S. PATENT DOCUMENTS

| | | | | |
|---|---|---|---|---|
| 2,701,235 A | | 2/1955 | King | |
| 3,252,576 A | | 5/1966 | Miller | |
| 3,306,448 A | | 2/1967 | Baker | |
| 3,616,916 A | * | 11/1971 | Greene | 210/121 |
| 3,701,427 A | | 10/1972 | Howard | |
| 4,126,925 A | * | 11/1978 | Jacuzzi | 29/428 |
| 4,154,679 A | | 5/1979 | Farage | |
| 4,212,740 A | * | 7/1980 | Greene | 210/169 |
| 4,325,150 A | * | 4/1982 | Buddy | 4/490 |
| 4,348,281 A | | 9/1982 | Perry et al. | |
| 4,776,953 A | | 10/1988 | Frentzel | |
| 5,085,767 A | | 2/1992 | Beers | |
| 5,395,509 A | * | 3/1995 | Guerra Cisneros et al. | 210/91 |
| 5,487,830 A | | 1/1996 | Huppert | |
| 5,581,826 A | | 12/1996 | Edwards | |
| 5,849,184 A | | 12/1998 | Veillet | |
| 5,863,425 A | * | 1/1999 | Herlehy et al. | 210/169 |
| 6,214,217 B1 | | 4/2001 | Sliger, Jr. | |

* cited by examiner

*Primary Examiner*—Fred G. Prince
(74) *Attorney, Agent, or Firm*—Edward A. Sokolski

(57) ABSTRACT

A filter system for filtering and collecting debris from a swimming pool is installed in the well along the sides of the pool. The system has a debris collector element in the form of a screen basket. A skimmer or weir element is in the form of a tube. The bottom end of this tube is connected to the top end of the collector basket. The top end of the tube receives water and debris when the water level in the well is low. The weir has a channel running completely therearound formed in its upper portion. When the water level in the well is low, the skimmer floats down to a position low enough to permit water and debris to pass therethrough into the basket. When the water level in the well is high, water enters the weir channel and drives the weir upwardly blocking the feeding of water and debris contained therein from the basket back into the well.

5 Claims, 1 Drawing Sheet

FILTER SYSTEM FOR A SWIMMING POOL

BACKGROUND OF THE INVENTION

1. Field of the Invention

This invention relates to a filter system for a swimming pool and more particularly to such a system employing a cylindrical weir which is less subject to damage and unauthorized removal.

2. Description of the Related Art

Prior, art pool filter systems installed in the wells of swimming pools generally employ a flap type weir as a skimmer in conjunction with a mesh screen basket collector for collecting debris. When the water level in the well is low, the flap drops down and permits water to enter the basket. When the water level in the well rises, the flap also rises preventing the escape of water and debris from the basket back into the pool. Systems of this type are described in U.S. Pat. No. 5,581,826 issued Dec. 10, 1996 to Edwards and U.S. Pat. No. 4,776,953 issued Oct. 11, 1988 to Frentzel.

The use of flap type weirs presents problems in that they are generally exposed and can readily be damaged accidentally or removed mischievously.

SUMMARY OF THE INVENTION

The device of the present invention is an improvement over the prior art in that rather than employing a flap type weir, it utilizes a weir which is cylindrical, or otherwise forms a conduit in some other shape,this weir being mounted so that it is not readily accessible to the users of the pool.

The weir of the present invention can readily be installed in a device employing a flap type weir to replace the weir. As in the prior art, the device of the present invention employs a screen collector basket which is mounted in the well of the swimming pool. In place of the flap weir, however, a weir in the form of a conduit which may be tubular, is removably slidably connected at its bottom end to the screen basket by means of a simple attachment device. A channel is formed in the upper portion of the conduit, this channel running around the wall of the conduit and closed off at its top. When the water level in the well is low, the weir skimmer drops down permitting water and any debris therein to enter the basket. When the water level in the pool is high, as, for example after water is pumper into the pool, the water enters the channel and drives the skimmer upwardly preventing the escape of water and any debris contained therein from escaping from the basket. The basket can readily be removed to empty and debris contained therein.

The present invention thus provides a simple system for removing debris from a swimming pool in which the skimmer is not likely to be damaged or removed without authorization.

It is therefore an object of this invention to provide an improved skimmer device for a swimming pool filtering system.

It is a further object of this invention to is provide a skimmer device for swimming pool filtering system which is less likely to be damaged or stolen.

It is a still further object of this invention to provide an improved skimmer for a swimming pool filter system which can readily be removed and reinstalled to permit emptying of the collection basket.

Other objects of the invention will become apparent in view of the following description taken in connection with the accompanying drawings.

DETAILED DESCRIPTION OF THE INVENTION

Figure 1:
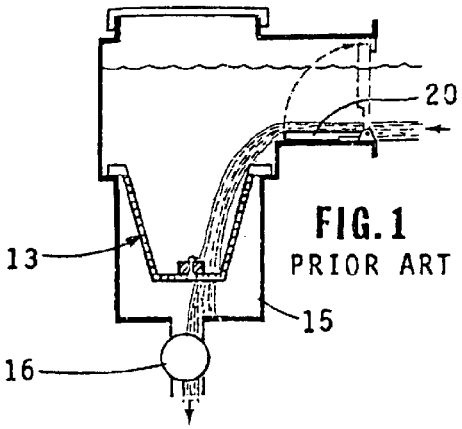
FIG. 1 PRIOR ART
FIG. 1 is a side elevational view showing a prior art flap weir skimmer.

Referring now to FIG. 1, a prior system using a flap type weir skimmer is illustrated. When the water level in the well 15 is lowered relative to that in the main portion of the pool(usually when water is being pumped into the pool), the flap is brought from the upward (dotted) position to the downward position as shown in the Figure. With the flap in this position, water and debris is permitted to flow from the well into collection basket 13. The debris is trapped in the basket with the water flowing out through control valve 16. With the water level in the well high, the flap is brought to the up position(shown dotted) whereat it closes the flow of water and debris out into the pool.

Referring now to FIGS. 2–6, weir element 11, in the preferred embodiment is cylindrical, but may be of other shapes which form a conduit. Weir skimmer 11 has an inner wall portion 11*a* in the upper skimmer portion which is spaced from the outer wall 11*b*. The inner and outer walls are joined together at their top ends to form a channel between the two walls which is closed off at its top. This channel is located in the upper portion of the skimmer.

Basket collector 13, has a screen for its side wall 13*a* as well as a screen bottom 13*b*Weir skimmer 11 is slidably and removably attached to basket collector 13 by means of connector device 12 in the following manner. Skimmer 11 has tabs 11*c* which extend outwardly from the bottom edge thereof. Tabs 11*c* fit into slots 12*a* formed on the upper rim of connector a 12. Once the tabs have been inserted in the slot, the skimmer is rotated several degrees to latch the tabs under the rim 12*b*, thereby retaining the skimmer to the connector for downward and upward slidable movement. Spring hooks 12*c* extend from the base rim 12*d* of the connector. Spring hooks 12*c* are removably attached to the basket collector by being fitted through selected screen apertures from the inside-out. With this type of attachment, the skimmer and basket can readily be removed from the well.

Figure 2:
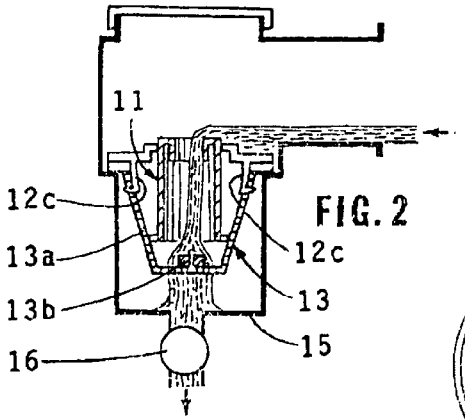
FIG. 2 is a side elevational view of a preferred embodiment of the invention with the weir skimmer in its lowered position with water and debris from the pool flowing into the basket.

As shown in FIG. 2 when the water level in the well is low as compared to that of the pool, which generally occurs when the water is being pumped into. the pool, the weir drops below the level of the pool and water and debris are permitted to pass into basket 13. The debris is trapped in the basket and subsequently can be removed therefrom.

Figure 3:
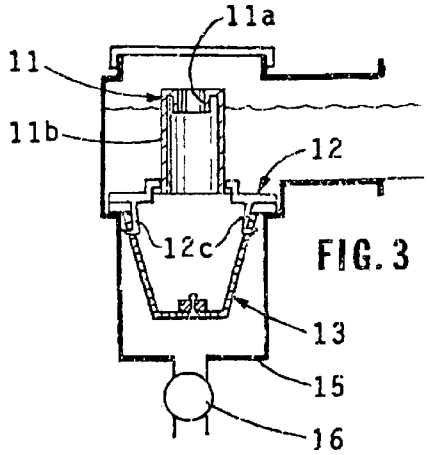
FIG. 3 is a side elevational view of the preferred embodiment of the invention showing the skimmer in its raised position without any water or debris flowing into or out of the skimmer and basket.
Figure 4:
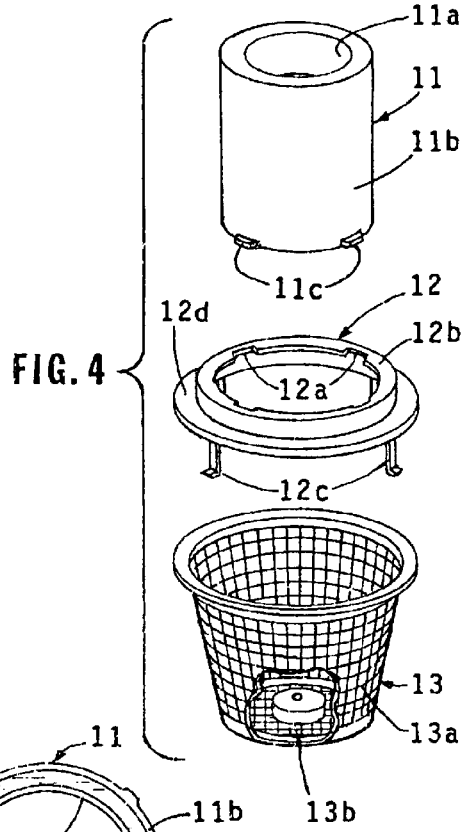
FIG. 4 is an exploded view of the preferred embodiment of the invention.
Figure 5:
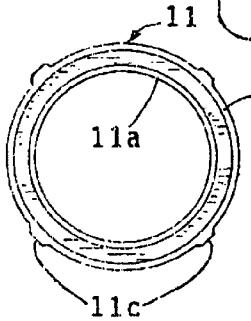
FIG. 5 is a bottom plan view of the weir of the preferred embodiment.
Figure 6:
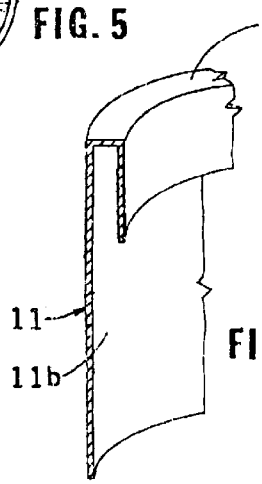
FIG. 6 is a cutaway perspective view illustrating the channel formed in the weir skimmer of the preferred embodiment.

As can be seen in FIG. 3, when the water level in the well is high, the water in the skimmer channel brings the skimmer upward so the top of the skimmer is above the water level. This prevents the passage of water and debris out from the basket back into the pool.

While the invention has been described and illustrated in detail it is to be understood that this is intended by way of illustration and example only, the scope of the invention being limited by the terms of the following claims.

I claim:

1. A filter system for filtering the water in a swimming pool and collecting the debris therein, said pool having a well running along at least one side thereof comprising:

a collector in the form of a basket member mounted in said well for collecting said debris;

a skimmer member in the form of a conduit, said skimmer member having upper and lower open ends for passing water and debris therethrough, said skimmer member further having a channel with a closed top formed in the upper portion thereof; and means for removably connecting the lower end of said skimmer member conduit to said basket comprising a connector member having upper and lower rings, said upper ring having slots formed therein, said conduit having tabs extending from the bottom edge thereof which fit through said slots, the lower ring of said connector member having spring hooks extending downwardly therefrom, said hooks engaging selected apertures in the screened side walls of said basket member.

2. The filter system of claim 1 wherein said conduit and said channel are tubular.

3. The filter system of claim 1 wherein said basket member has screened side and bottom walls.

4. The system of claim 2 wherein said channel is in the form of an inner tubular wall running opposite the wall of said tubular skimmer in spaced relationship thereto.

5. A system for filtering the water in a swimming pool and collecting the debris therein, said pool having a well running around the sides thereof comprising:

a collector basket for collecting debris having screened side and bottom walls, said collector basket being mounted in said well;

a tubular skimmer weir slidably supported in said basket, said skimmer weir having a tubular channel formed in the top portion thereof, said channel being formed by a tubular inner section spaced from the inner wall of said skimmer weir and joined to the top edge of the skimmer weir by a top wall; and a connector member for removably joining said skimmer weir to said basket comprising top and bottom ring portions, said top ring portion having a plurality of slots, said skimmer weir having a plurality of tabs which are fitted into said slots and rotated to provide slidable connection to said top ring portion, the bottom ring portion having a plurality of spring hooks extending therefrom which are fitted through selected apertures of the screened sides of said basket.

* * * * *